US007375344B2

(12) United States Patent
Derrick et al.

(10) Patent No.: US 7,375,344 B2
(45) **Date of Patent: *May 20, 2008**

(54) ION FOCUSSING AND CONVEYING DEVICE AND A METHOD OF FOCUSSING AND CONVEYING IONS

(75) Inventors: Peter John Derrick, Warks (GB); Alexander William Colburn, Coventry (GB); Anastassios Giannakopulos, Milton Keynes (GB)

(73) Assignee: Peter Derrick, Warwickshire (GB)

( * ) Notice: Subject to any disclaimer, the term of this patent is extended or adjusted under 35 U.S.C. 154(b) by 46 days.

This patent is subject to a terminal disclaimer.

(21) Appl. No.: 11/107,617

(22) Filed: Apr. 15, 2005

(65) Prior Publication Data

US 2005/0178973 A1 Aug. 18, 2005

Related U.S. Application Data

(63) Continuation of application No. 10/416,936, filed as application No. PCT/GB01/05174 on Nov. 23, 2001, now Pat. No. 6,894,286.

(30) Foreign Application Priority Data

Sep. 23, 2000 (GB) ..... 0028586.6

(51) Int. Cl.
*G21K 1/08* (2006.01)
*H01J 3/14* (2006.01)

(52) U.S. Cl. ..... 250/396 R; 250/292

(58) Field of Classification Search ..... 250/396 R, 250/282, 292, 423 R

See application file for complete search history.

(56) References Cited

U.S. PATENT DOCUMENTS

| | | | | |
|---|---|---|---|---|
| 5,206,506 | A * | 4/1993 | Kirchner | 250/281 |
| 5,811,820 | A * | 9/1998 | Kirchner et al. | 250/432 R |
| 6,107,628 | A * | 8/2000 | Smith et al. | 250/292 |
| 6,593,570 | B2 * | 7/2003 | Li et al. | 250/290 |
| 6,759,651 | B1 * | 7/2004 | Li | 250/288 |
| 6,894,286 | B2 * | 5/2005 | Derrick et al. | 250/396 R |
| 6,903,331 | B2 * | 6/2005 | Bateman et al. | 250/287 |
| 6,960,760 | B2 * | 11/2005 | Bateman et al. | 250/286 |
| 2004/0046124 | A1 * | 3/2004 | Derrick et al. | 250/396 R |

* cited by examiner

*Primary Examiner*—Robert Kim
*Assistant Examiner*—Johnnie L Smith, II
(74) *Attorney, Agent, or Firm*—Wood, Phillips, Katz, Clark & Mortimer

(57) ABSTRACT

An ion focusing and conveying device 10 comprises a plurality of electrodes 12 in series. Means is provided to apply a first alternating voltage waveform to each electrode 12, the phase of the alternating voltage in the first waveform is applied to each electrode 12 in the series being ahead of the phase of the first alternating voltage waveform applied to the preceding electrode 12 in the series by less than 180°, preferably by 90° or less, such that ions are focused onto an axis of travel and impelled along the series of electrodes 12.

62 Claims, 8 Drawing Sheets

ION FOCUSSING AND CONVEYING DEVICE AND A METHOD OF FOCUSSING AND CONVEYING IONS

The invention relates to an ion focusing and conveying device and to a method of focusing and conveying ions.

Mass spectrometers include a source of ions. One technique to obtain ions is electrospray ionisation (ESI) which is an ionisation method which operates at atmospheric pressure. A solution of analyte molecules is sprayed from the tip of a needle held at high potential producing an aerosol of charged droplets. Bulk transfer properties carry the droplets towards and through an aperture (sometimes a capillary tube) into a low pressure region of the ion source where the pressure is usually between 0.1 mbar and 10 mbar. A second aperture (sometimes a conical skimmer) allows a portion of the expanding jet from the first aperture to pass into a lower pressure region and eventually into the mass analyser. The apertures form conductance restrictions between each vacuum stage necessary for the differential pumping system to operate efficiently. During the passage from atmospheric pressure to the low pressure region within a mass analyser, evaporation of the solvent in the droplet occurs and finally molecule ions are produced.

Current ESI source designs exhibit poor transmission efficiency due to the considerable loss of charged entities to parts surrounding the various apertures. Experimental measurements have shown that with some sources less than 1 part in $10^3$ of the available current passes through the first aperture and less than 1 part in $10^2$ of that passes through the second aperture. Overall, less than 1 part in $10^5$ of the electrospray needle current is typically available as ion current into the mass spectrometer. In order to improve transmission efficiency, a mechanism of focusing the charged entities into the apertures is required. Conventional electrostatic optics techniques, which would be used in high vacuum, do not work in these higher pressure regions due to the large number of collisions with surrounding gas molecules. Electrostatic optics techniques generally require the energy of transmitted entities to be conserved during their passage through the optical system.

According to one aspect of the invention there is provided an ion focusing and conveying device comprising a plurality of electrodes in series, and means to apply at least one alternating voltage waveform to each electrode, the phase of the alternating voltage in the or a first waveform applied to each electrode in the series being ahead of the phase of the or the first alternating voltage applied to the preceding electrode in the series by less than 180° such that ions are focused onto an axis of travel and impelled along the series of electrodes.

The trapping and focusing action of this device comes from a development of the "Paul effect". The Paul effect itself is shown where apertured electrodes are arranged in series. An alternating radio-frequency (RF) voltage is applied to alternate electrodes of the series and an alternating voltage in anti-phase to the first is applied to the other electrodes in the series so as to produce an alternating field with a field-free region at its center between the electrodes. This effect produces focusing of charged entities trapping them in a field-free region along a central axis. In the invention, the voltages applied to adjacent electrodes in the series are systematically deviated from the anti-phase condition to result in a field which pulls the ions through the device.

The principle of operation of the device is thus to produce an alternating electric field or combinations of fields, which have the properties of focusing, collimating, trapping and transmitting charged entities entering the device and reducing the kinetic energies of the entities to a common low value. The entities may have a large spread of mass, energy and position on entering the device. The mechanism of operation is the application of multiple-voltage waveforms to a repetitive series of electrodes where the relative phases and shapes of the waveforms are tailored to produce the desired alternating electric field.

In the case of an ESI source of a mass spectrometer, this means that rather than obtaining less than 1 part in $10^5$ of the electrospray needle current as ion current into the mass analyser, a much higher proportion of the ions produced can be supplied into the mass analyser, due to the focusing, collimation and transmission of the ions.

The phase-difference between adjacent electrodes may each be set at any suitable level, and preferably there is a common phase-difference between all adjacent electrodes. The common phase-difference is preferably 360°/n where n is a natural number greater than two, and preferably greater than three, as this leads to a smoother transmission of the ions. The means to apply alternating voltages to the electrodes may apply voltages in any suitable waveform and in one preferred embodiment the means to apply alternating voltages applies alternating voltages with a sinusoidal waveform to the electrodes. Triangular (i.e. saw tooth) and square waveforms can also be used.

The frequency of the or the first applied alternating voltage may be at any suitable desired level, but preferably is less than 100 kHz.

The frequency of the or the first applied alternating voltage may be altered in use and preferably is swept, for example, over a range of at least 100 kHz. This flattens the transmission efficiency curve and avoids high mass stagnation.

In one embodiment, the alternating voltages applied may include a further superimposed component consisting of anti-phase voltages applied to alternate electrodes. Thus, the means to apply alternating voltages may also be arranged to apply a second alternating voltage waveform to each electrode simultaneously with the first such that anti-phase alternating voltages are applied to alternate electrodes. A composite waveform is thus applied. The anti-phase voltages generate a series of static Paul traps along the axis of the device. The applied composite waveform thus promotes transmission between Paul traps in the direction of wave propagation. The application of the anti-phase voltages assists in very low pressure regions, as the radial focusing effect is enhanced. The difficulty in such low-pressure regions is that an ion travelling in a direction away from and out of the electric field produced by the electrodes may not collide with another particle until it is too far from the field for the focusing of the field to be effective. Thus fewer particles are actually focused, unless the focusing effect of the field is enhanced as described. The second alternating voltage waveform may be 1 to 4 MHz in frequency.

The distance between the electrodes may be any suitable distance and preferably there is the same distance between each of the adjacent electrodes. The electrodes may be of any desired shape and may all be identical. Preferably each electrode defines a central aperture, which may be of any desired shape and in one preferred embodiment is circular, and in another preferred embodiment is a slit.

In one embodiment the electrodes or the field applied thereby is conveniently arranged to focus the ions to and to impel them along a straight path through the device. In another embodiment, however, the electrodes or field is arranged to focus the ions to and to impel them along a curved path. In use, when ions are admitted to the device, neutral entities such as gas molecules, droplets of liquid and other matter will also enter the device and these will affect the pressure within the device and hence the frequency of collision of the ions and the effectiveness of focusing and impelling of the ions. More seriously, however, where the device feeds a mass analyser, the neutral matter can pass through the device and interfere with analysis by the analyser. By arranging the electrodes or field to focus the ions to and to impel them along a curved path, the ions will take a different path from the uncharged entities and so the effect of the presence of the admitted neutral entities can be minimised. A non-straight path may also be desirable for spatial arrangement or other reasons. The path may curve in only one direction or may be S-shaped or may curve in more directions. The curved path may have a constant radius or the radius may vary, as desired. Preferably the electrodes are arranged in the curved path. The electrodes may be planar and may lie on planes which are substantially radial to the curve.

According to another aspect of the invention there is provided a method wherein a method of focusing and conveying ions comprising applying at least one alternating voltage waveform to each of a plurality of electrodes in series, the phase of the or a first alternating voltage applied to each electrode in the series being ahead of the phase of the or the first alternating voltage applied to the preceding electrode in the series by less than 180° such that the ions are focused on to an axis of travel and advanced along the series of electrodes.

The phase-difference between the electrodes may be set at any suitable level, and preferably there is the same phase-difference between each of the adjacent electrodes. The phase-difference is preferably 360°/n where n is a natural number greater than two, and preferably greater than three, as this leads to a smoother transmission of the ions. The waveform of the applied alternating voltage may be of any suitable shape and may be sinusoidal, triangular or square. The alternating voltages applied may include a further superimposed component consisting of anti-phase voltages applied to alternate electrodes.

The voltages may be applied to the electrodes and/or the electrodes may be arranged such that ions are focused and advanced along a straight, or a curved path.

Embodiments of the invention will now be described by way of example and with reference to the accompanying drawings, in which.

Figure 4A:
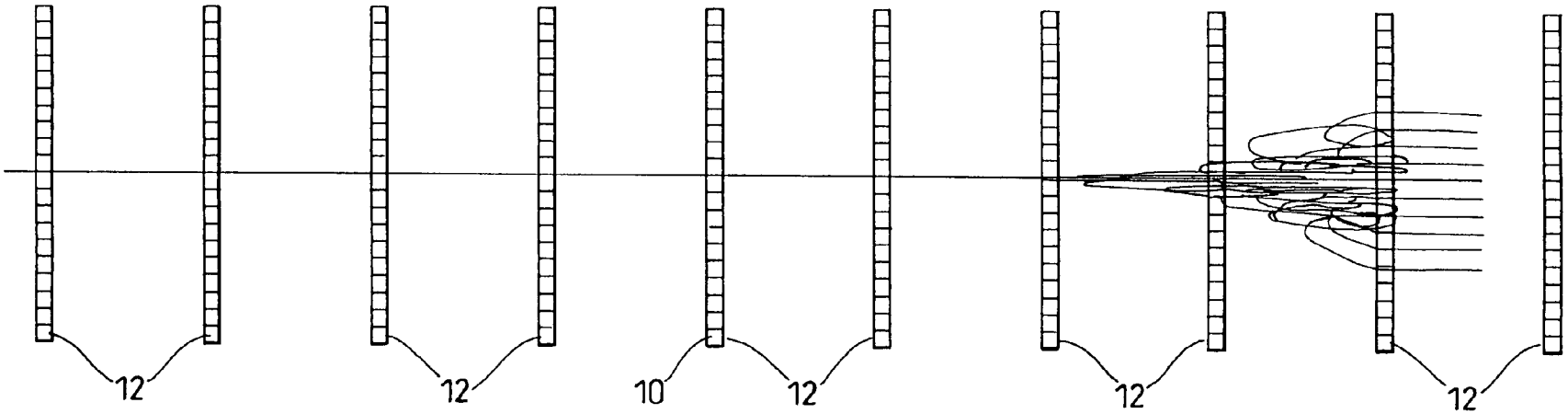
Figure 4B:
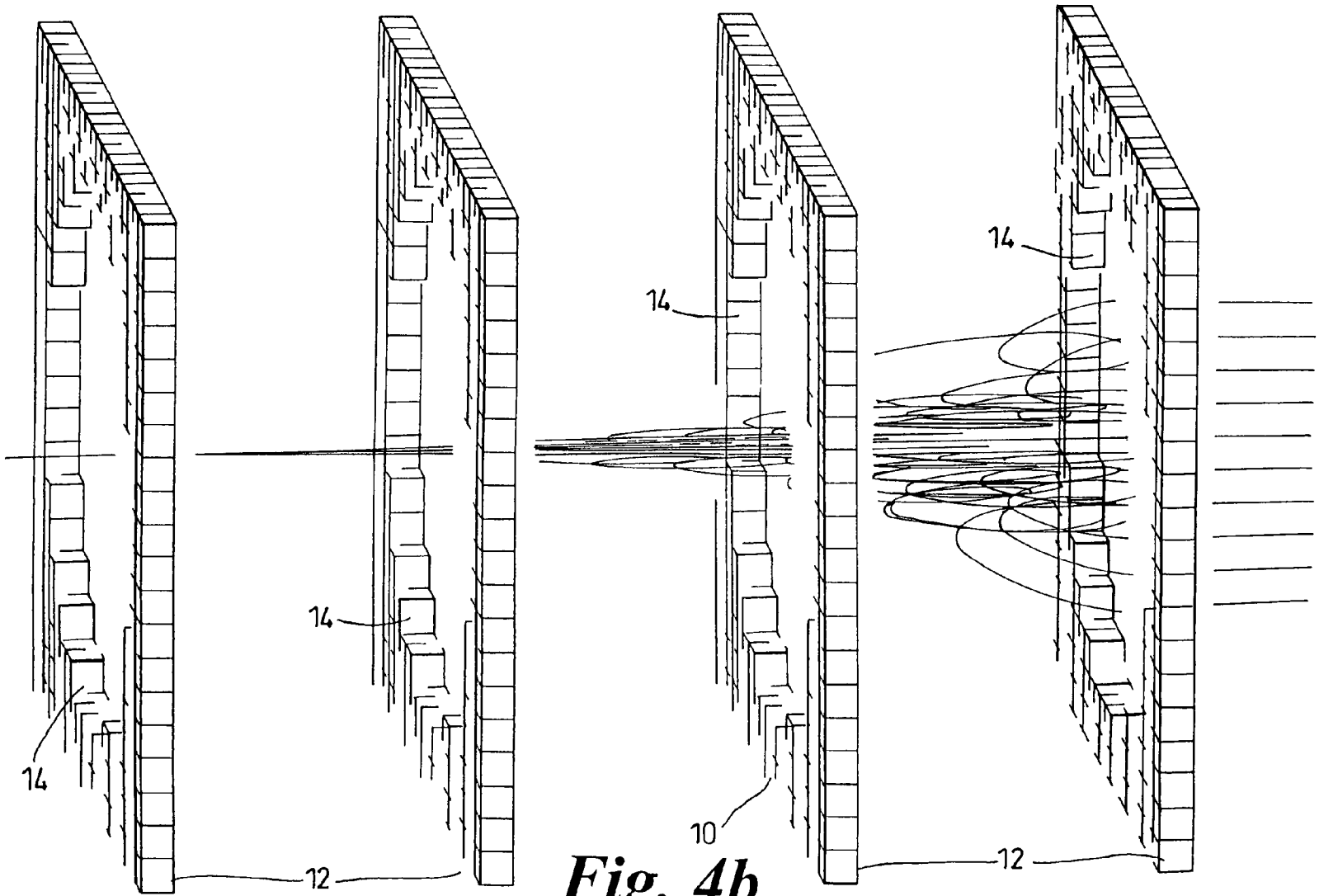

FIG. 4*a* is a plan view of computer modeled ion movement paths in the device of the first embodiment under a first applied voltage condition;

FIG. 4*b* is a detail perspective view of the paths shown in FIG. 4*a;*

Figure 5:
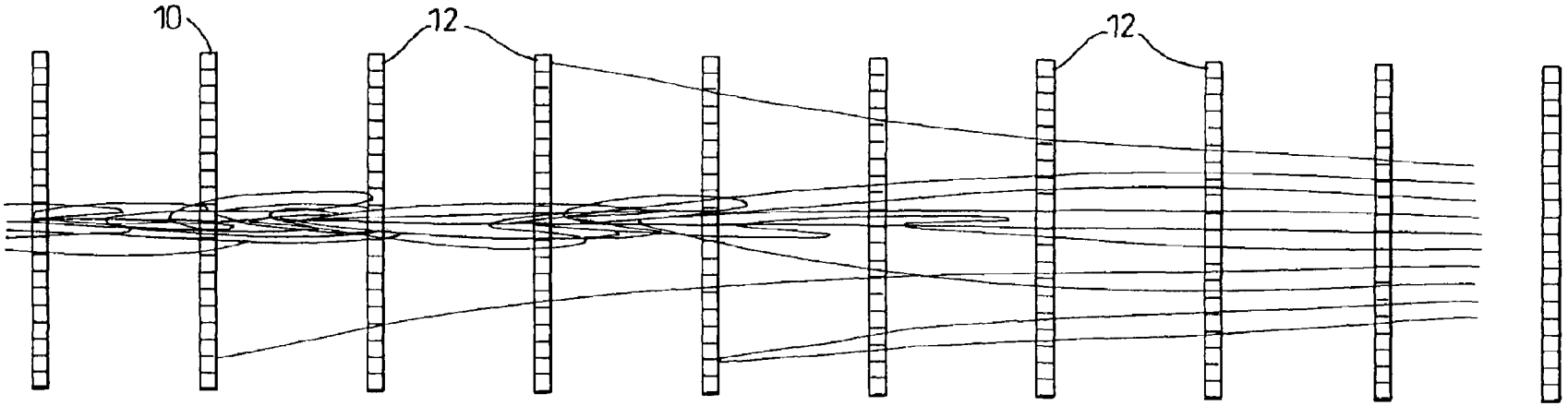

FIG. 5 is a plan view of computer modeled ion movement paths in the device of the first embodiment under lower pressure than in FIGS. 4*a* and 4*b;*

Figure 6A:
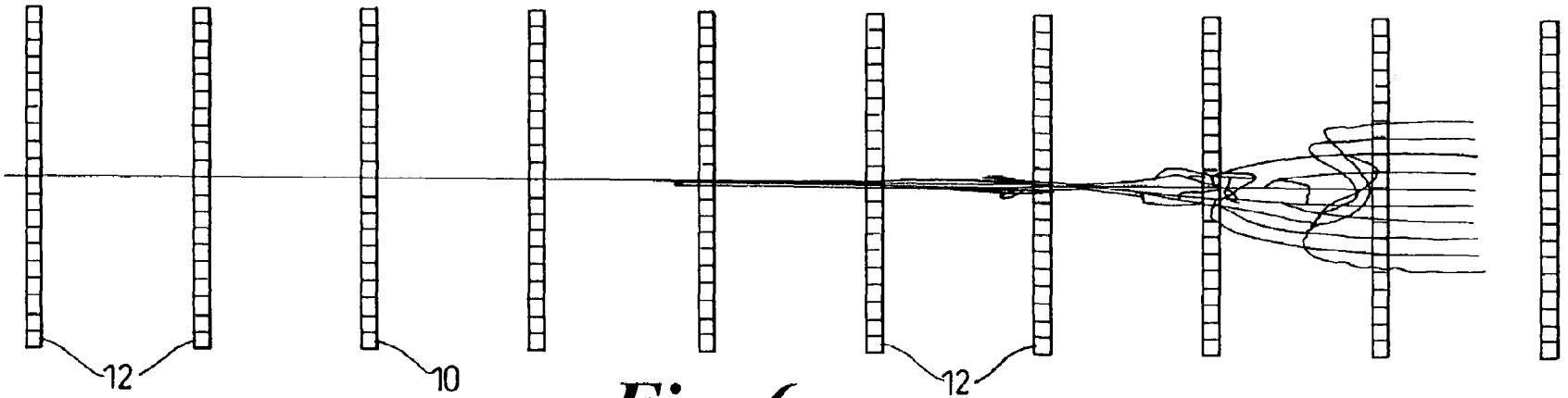
Figure 6B:
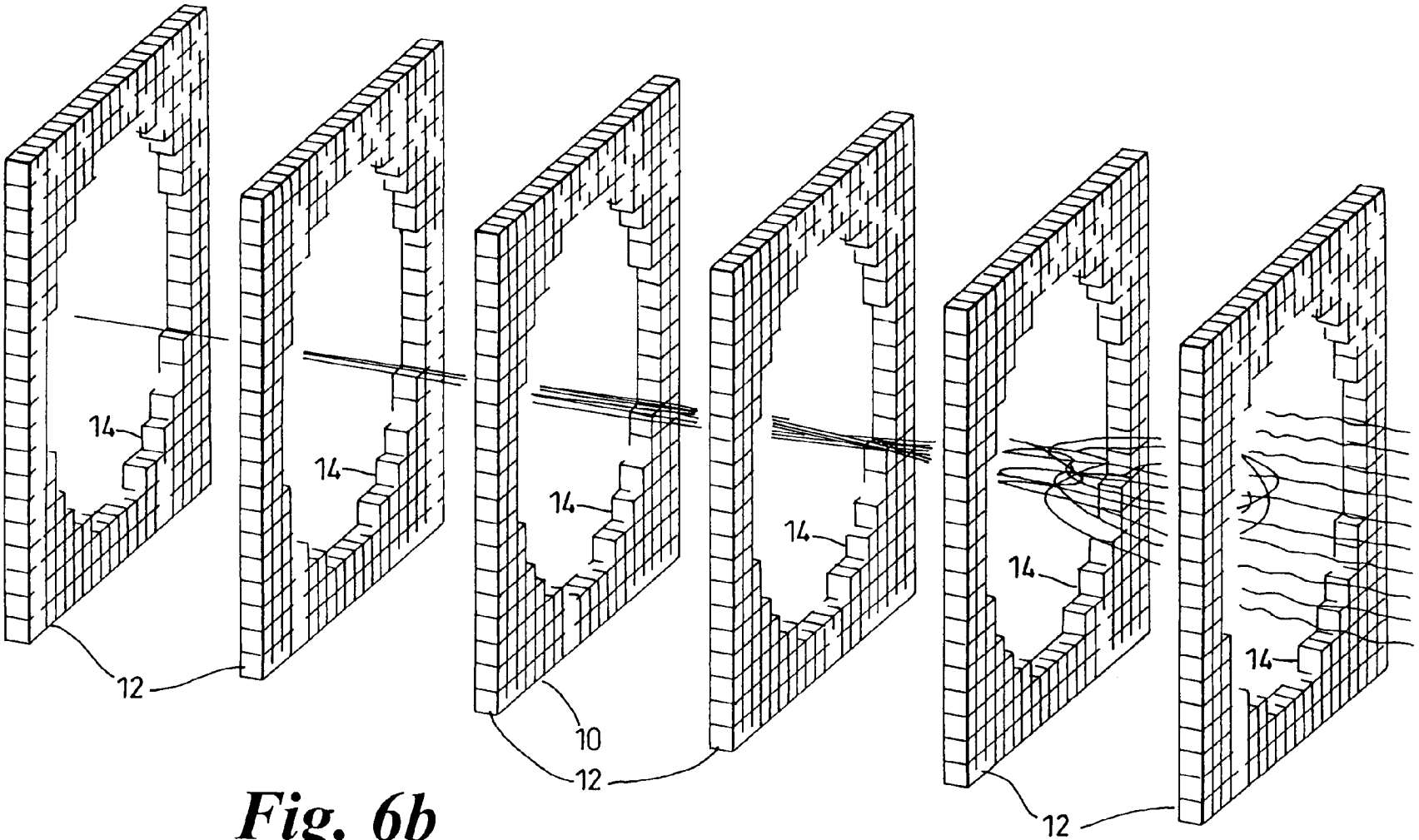
Figure 7:
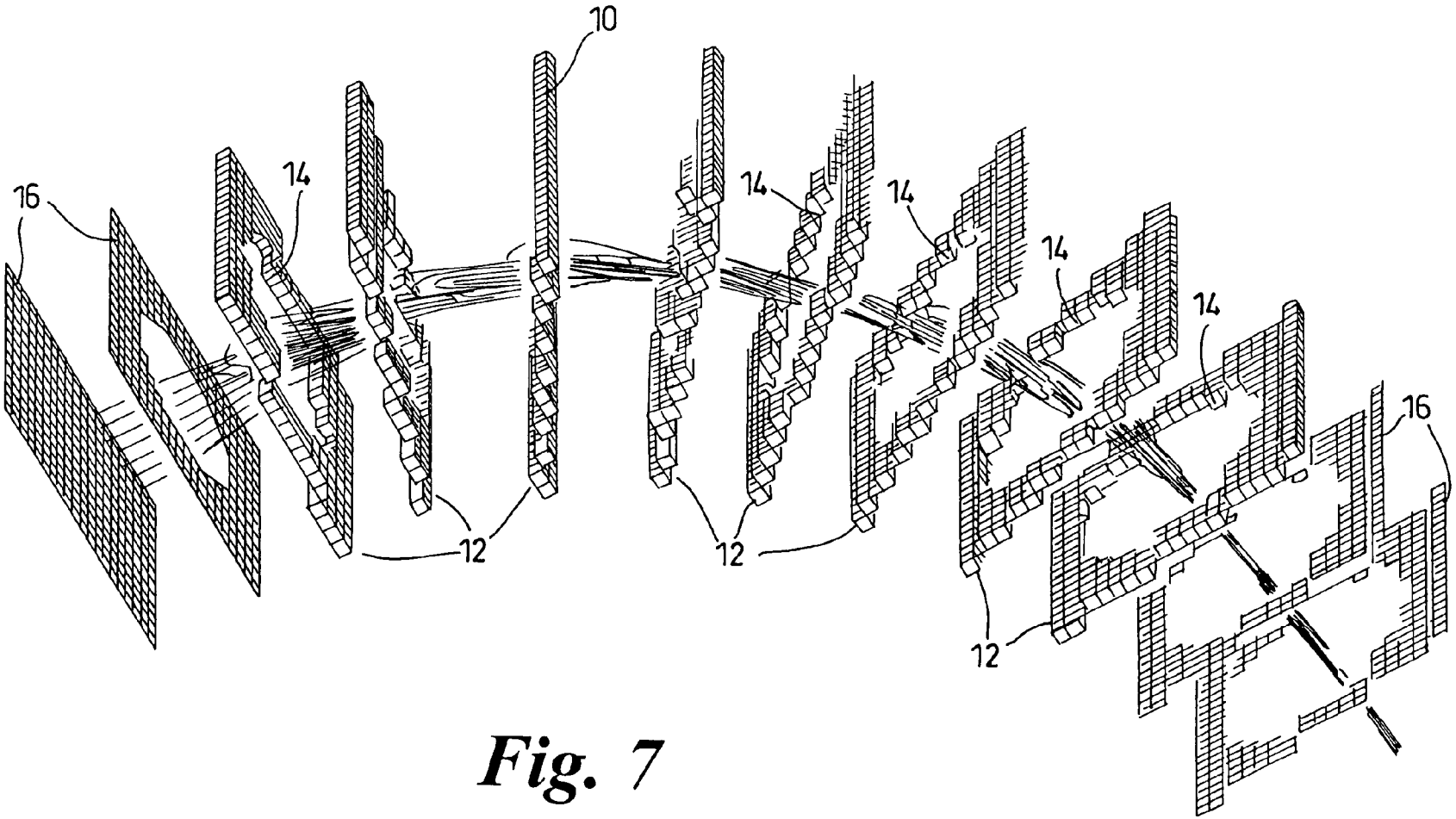

FIG. 6*a* is a plan view of computer modeled ion movement paths in the device of the first embodiment under a second applied voltage condition and the same pressure as in FIG. 5;

FIG. 6*b* is a detail perspective view of the paths shown in FIG. 6*a*; and, FIG. 7 is a perspective view of the device of the second embodiment of the invention.

Figure 1:
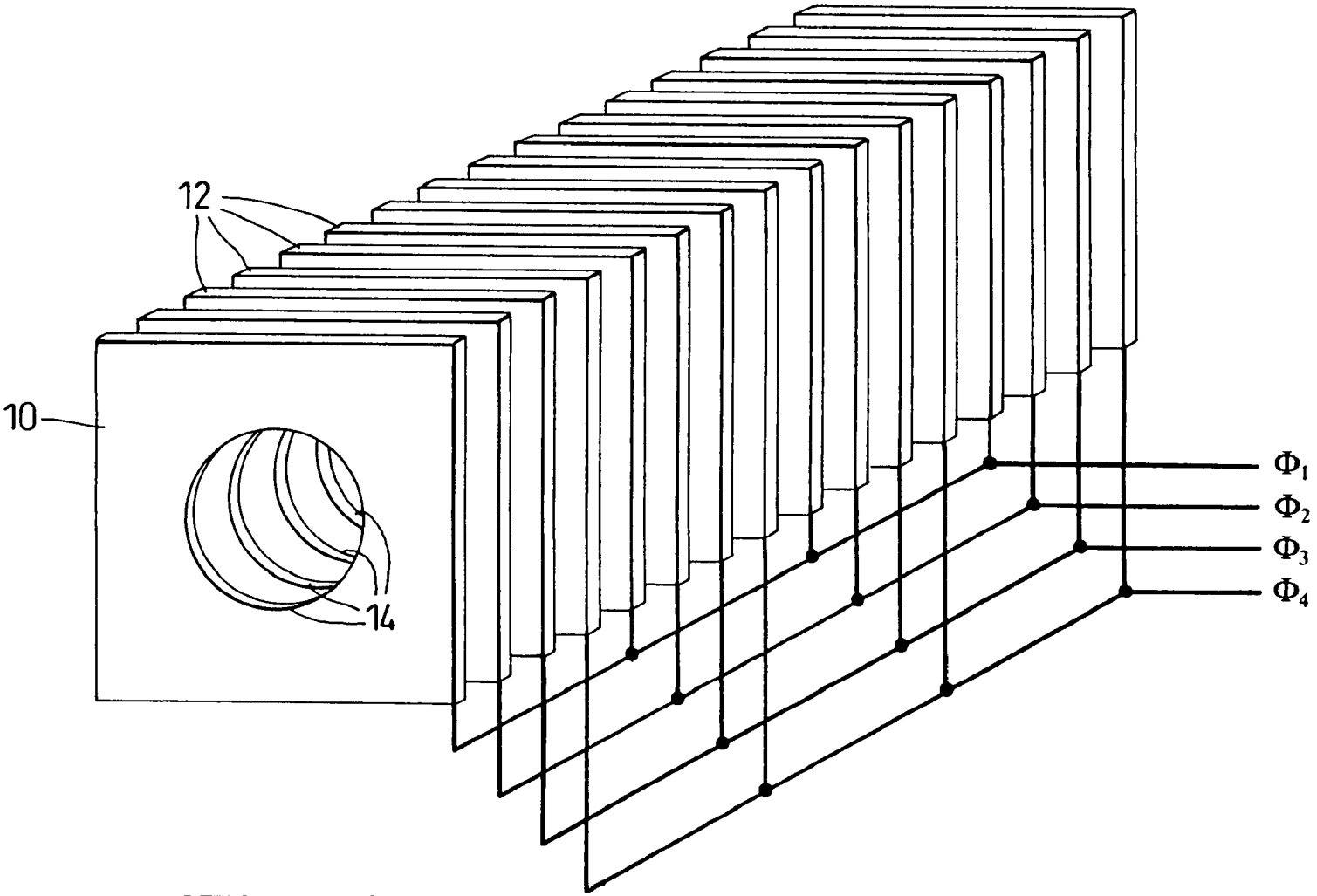
FIG. 1 is a perspective view of the device of the first embodiment of the invention.

The device 10 of the embodiment of the invention comprises, as shown in FIG. 1, a series of square electrode plates 12, each with a circular central aperture 14. The plates 12 are arranged in parallel planes with the centers of the circular apertures 14 aligned along an axis. The cross-section of both the electrode plates 12 and the apertures 14 may take other shapes such as, elliptical, rectangular or indeed any regular or irregular polygon or curve, such shapes being used to define the symmetric or asymmetric performance of the device. The apertures 14 are about 20 mm in diameter and the spacing between adjacent electrode plates 12 is about 10 mm. As shown, every fourth electrode plate 12 is connected to a common alternating voltage source Φ1 to Φ4, the sources differing in phase.

Figure 2:
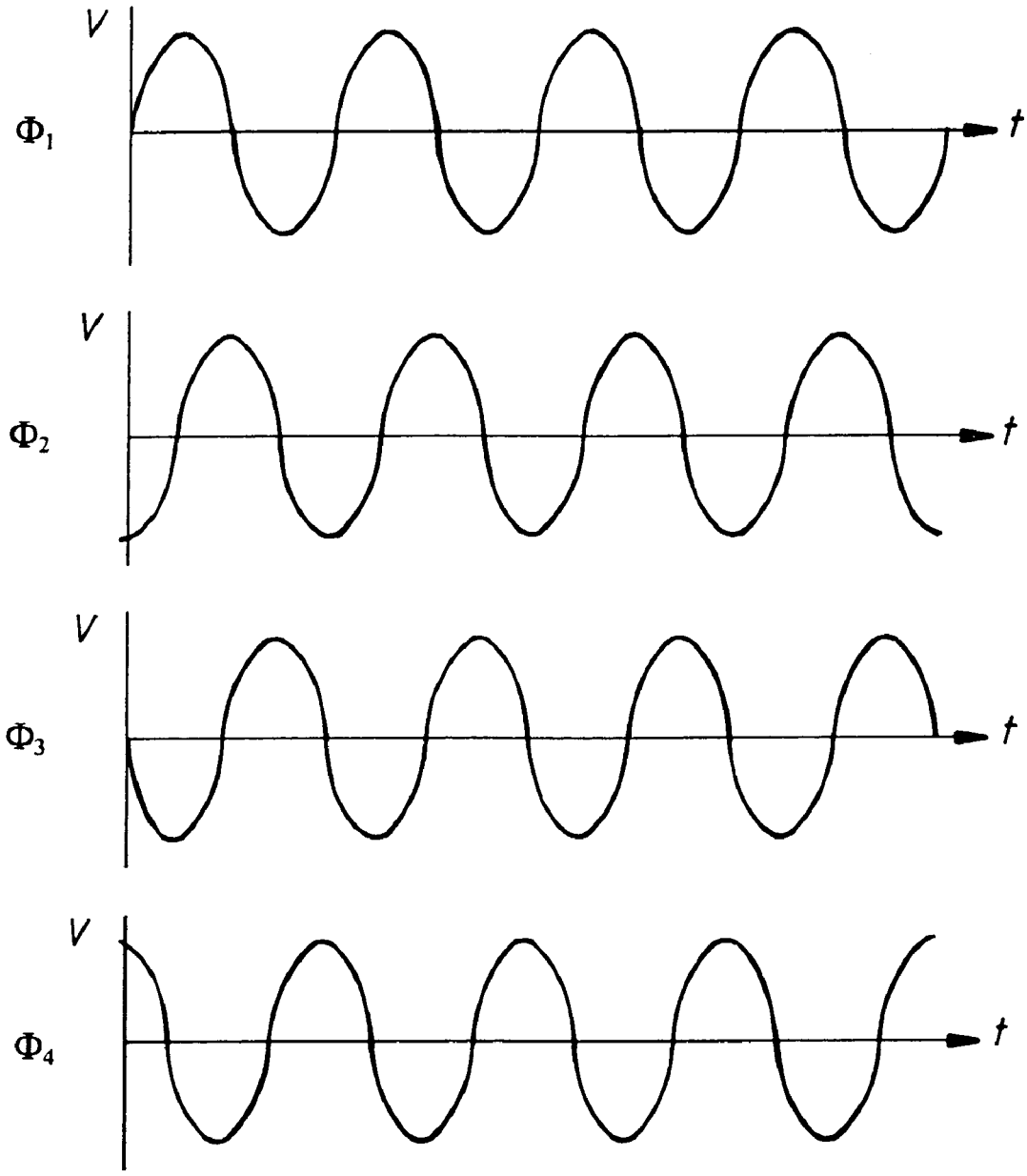
FIG. 2 is four graphs of voltage waveforms having the same time axis, the waveforms representing the phases of the alternating voltages applied to each set of four electrodes in the series shown in FIG. 1.
Figure 3:
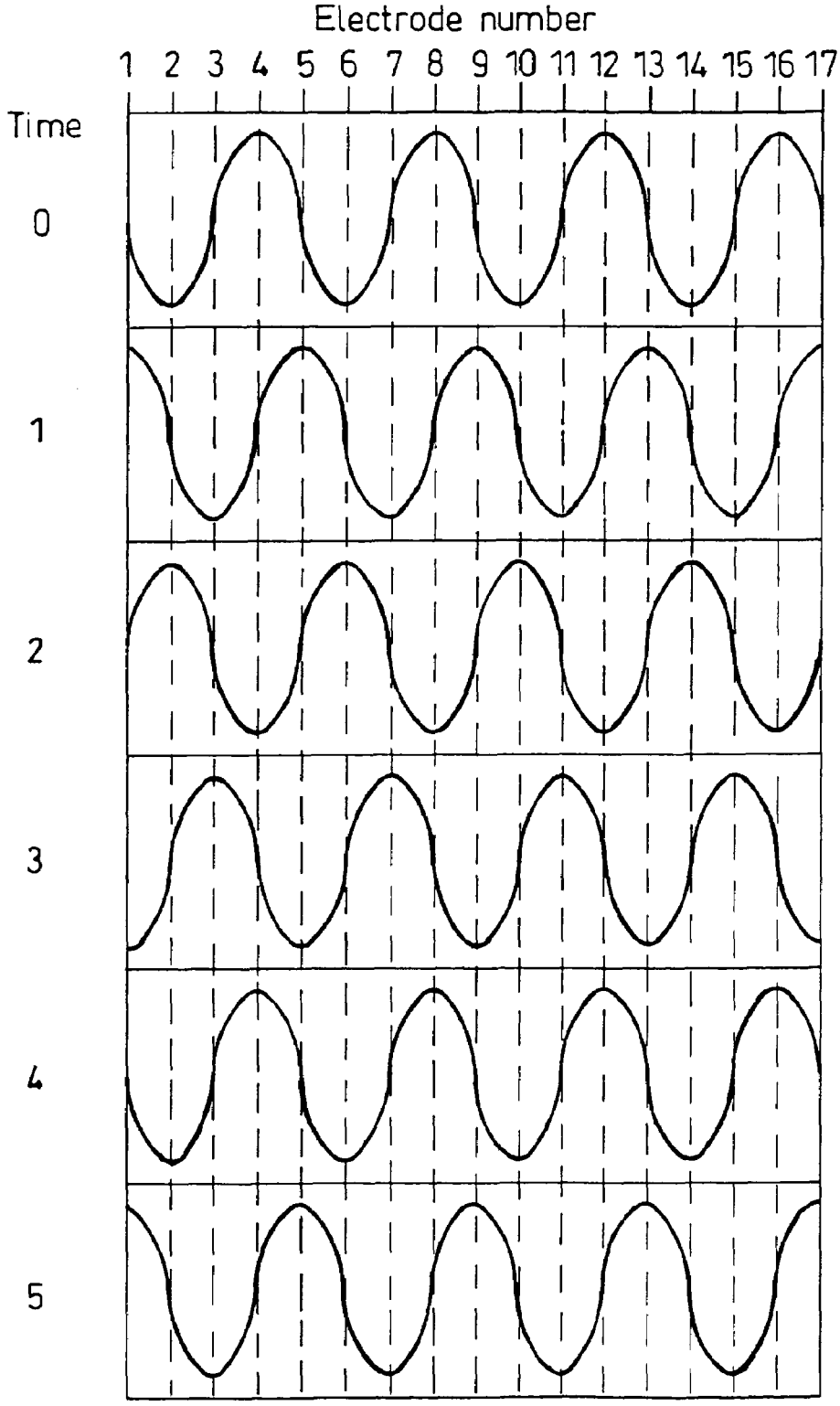
FIG. 3 is a temporal series of graphs of voltage against electrode location in the device of FIG. 1.

FIG. 2 shows an example of a series of suitable voltage waveforms for the sources Φ1 to Φ4, namely, four sinusoids phase shifted 90° with respect to each other. Such suitable waveforms are hereafter collectively called "conveyor" waveforms. The conveyor waveforms are applied to the electrodes 12 sequentially and repetitively according to the number of phases employed. FIG. 3 shows a series of temporal snapshots of the voltages applied to the series of electrodes 12. The effect of the conveyor waveforms is to produce a travelling wave as a function of time, which is reflected in the electric field produced within the electrode structure. Reversal in order of the conveyor waveforms causes the wave to propagate in the opposite direction. This four-phase sinusoid configuration is the lowest order solution which provides a smooth propagation wave. Equation I shows the relationship between the propagation velocity of the wave (v), electrode spacing (l) and frequency of applied conveyor waveforms (f).

$$v=4lf \tag{I}$$

The action of this travelling wave is to push any charged entity within the electric field in the direction of propagation of the wave, providing motive force for transmission through the device 10. The trapping and focusing action of this device comes from the "Paul" effect in which two anti-phase radio-frequency (RF) voltages are applied to alternate electrodes in the structure to produce an alternating field with a field-free region at its center. This effect produces radial focusing of the charged entities at the center of the electrodes trapping them in a series of field-free regions along the central axis of the device. The conveyor waveforms utilised here form two pairs of anti-phase voltages producing a series of inter-linked Paul traps which propagate axially along the device.

FIGS. 4*a* and 4*b* show a Simion 6 ion trajectory simulation for the device 10 utilising the illustrated conveyor waveforms, where FIG. 4*a* is a 2-dimensional plot of ion trajectories and 4*b* is a close-up 3-dimensional plot of the focusing region. A voltage of 3 kV was applied at an alternating frequency of 500 kHz. Ten trajectories for an ion of mass 1000 amu with energy 200 eV are plotted from a series of positions across the aperture of the device with a short mean free path set to simulate medium to high pressure regions. Prompt radial focusing occurs as the ions describe orbits in the alternating electric field with the orbital motion collapsing into an oscillatory motion along the central axis of the device 10. As the ions reach the central axis the propagation wave dominates their motion pushing them through the device 10.

FIG. 5 shows a Simion 6 ion trajectory simulation where the mean free path has been increased by an order of magnitude to simulate low pressure regions. At low pressures where the mean free path is large and energy loss due to collisions is small the efficiency of radial focusing and trapping decreases. This is because the velocity of the charged entity carries it away from the influence of a given electrode 12 before it has experienced the influence of a full cycle of the alternating electric field, necessary for effective trapping. Increasing the frequency of the conveyor waveforms to increase trapping efficiency results in a proportionate increase in wave propagation velocity leading to increased velocity of the charged entities. The net result is little improvement in trapping efficiency and increased energy spread.

It is possible to modify the conveyor waveforms applied to the electrodes 12 to restore good performance in low pressure regions. By applying anti-phase RF voltages at, say, 2 MHz, to alternate electrodes 12 a series of static Paul traps is generated along the axis of the device. The conveyor waveforms can be superimposed on the RF voltages to produce four "composite" waveforms. The superimposed conveyor waveform promotes transmission between Paul traps in the direction of wave propagation. FIGS. 6*a* and 6*b* show Simion 6 ion trajectory simulations for the device 10 utilising the composite waveforms, where FIG. 6*a* is a 2-dimensional plot of ion trajectories and FIG. 6*b* is a close-up 3-dimensional plot of the focusing region. The simulation parameters are the same as for FIG. 5 (i.e. the same low pressure) except for the application of composite waveforms.

Both variations, namely the conveyor and composite waveforms, show good radial focusing properties. Transmission efficiency is good over a large mass range but is related to the conveyor frequency, higher masses take longer to propagate through the device 10 for a given conveyor frequency. For very large mass ranges the conveyor frequency may be swept in order to flatten the transmission efficiency curve and avoid high mass stagnation.

The device or multiple devices can thus be interposed between an electrospray needle and a mass analyser, for example, in place of the first and second apertures described (which can be defined by a capillary tube and a conical skimmer) and will allow a very high proportion of the ions produced to be focused for use rather than lost as in the known technique described.

The device is in no way limited to use with ESI sources and could be used with MALDI (Matrix Assisted Laser Desorption/Ionisation) sources, atmospheric MALDI sources, chemical ionisation sources or any other suitable ion source.

The device can be used with any suitable kind of mass spectrometer such as a Fourier Transform Ion Cyclotron Resonance (FTICR) spectrometer, quadrupole spectrometer, ion trap spectrometer or orthogonal time-of-flight spectrometer, for example. The device can be used for RF ion traps in which pressure within the mass analyser is high due to the presence of buffer gas.

Combinations of the device utilising both conveyor and composite waveforms may be used to control the transmission of charged entities from high pressure regions through to low pressure regions and if required back to high pressure regions and to control their kinetic energies. Use of this device as a collision cell or modification of a multipole by division of the multipole into discrete electrodes and application of the conveyor waveforms to assist transmission are examples of application.

The two basic elements, being the conveyor and the Paul trap waveforms, represent extremes, between which lie a continuous range of different operating devices.

The device 10 of the second embodiment as shown in FIG. 7 is similar to that of the first and only the differences from the first embodiment will be described. The same reference numerals will be used for equivalent features.

In the second embodiment, the electrodes 12 are the same as in the first embodiment but instead of being arranged with the centers of the apertures 14 in a straight line, they are arranged in a smooth curve of constant radius. The radius at the center line or so-called "optical axis" is 60 mm. The electrode plates 12 are arranged at 10° intervals and eight are shown, so that the ion path is curved through 80°. There are two charged sheets 16 at each end of the device 10 and there is no curvature of the path between the sheets 16 at each end. As mentioned, the ion path within the device 10 is kept at a controlled low pressure. When ions are admitted to the device 10 gas or other molecules are drawn in by the vacuum together with other neutral entities. In the case where the device 10 is used with an ESI source, droplets of solvent may enter the device 10. These uncharged entities will not be affected by the applied electric field in the same way as the ions and so will tend to continue to travel through the device 10 in a straight path. In the device 10 of the first embodiment, this will take them along the ion path, which is undesirable, in particular where the device 10 feeds into a mass analyser into which the uncharged entities may pass with the focused ions. In the device 10 of the second embodiment, the ion path is curved and so the ions are diverted away from the likely path of the uncharged entities and so interference with the desired pressure is minimised. It is seen that focusing does not take place as quickly as in the device 10 of the first embodiment but this can be compensated for by adding more electrode plates 12 or by adding electrodes 12 on a straight path at the end of the curve.

Two effects are seen. One is that the ions are curved away from a straight path by the electric field from the electrodes 12. The other is that the electrodes themselves deflect the neutral entities away from the path taken by the ions. The straight path, as shown at 18, taken by the neutral entities will hit an electrode 12 along the ion path which is at an angle to the straight path such that it will deflect the incident entities.

The invention claimed is:

1. An ion focusing and conveying device comprising a plurality of electrodes in series, and means to apply an electrical signal to each electrode, the said means being arranged to apply only one electrical signal to each electrode, the electrical signal being an alternating voltage waveform, the phase of the alternating voltage in the alternating voltage waveform applied to each electrode in the series being ahead of the phase of the alternating voltage waveform applied to the preceding electrode in the series by less than 180° such that ions are focused onto an axis of travel and impelled along the series of electrodes.

2. A device as claimed in claim 1, wherein there is a common phase-difference between all adjacent electrodes.

3. A device as claimed in claim 2, wherein the common phase-difference is 360°/n, where n is a natural number greater than two.

4. A device as claimed in claim 2, wherein the common phase-difference is 360°/n, where n is a natural number greater than three.

5. A device as claimed in claim 1, wherein the means to apply an electrical signal applies an alternating voltage waveform with a sinusoidal waveform to each electrode.

6. A device as claimed in claim 1, wherein the frequency of the alternating voltage waveform applied to each electrode is less than 100 kHz.

7. A device as claimed in claim 1, wherein the frequency of the alternating voltage waveform applied to each electrode is altered in use.

8. A device as claimed in claim 7, wherein the frequency of the alternating voltage waveform applied to each electrode is swept.

9. A device as claimed in claim 8, wherein the frequency of the alternating voltage waveform is swept over a range of at least 100 kHz.

10. A device as claimed in claim 1, wherein there is the same distance between each of the adjacent electrodes.

11. A device as claimed in claim 1, wherein the electrodes are all identical.

12. A device as claimed in claim 1, wherein each electrode defines a central aperture.

13. A device as claimed in claim 1, wherein the plurality of electrodes or field is arranged to focus the ions to and impel them along a curved path.

14. A device as claimed in claim 13, wherein the electrodes are planar and lie on planes which are substantially radial to the curve.

15. A device as claimed in claim 1, wherein the pressure in the device is 0.1 mbar or more.

16. A device as claimed in claim 1, wherein the pressure in the device is 10 mbar or more.

17. Apparatus consisting of an ion source supplying ions directly into a device according to claim 1, which in turn supplies ions directly into a mass analyser.

18. Apparatus as claimed in claim 17, wherein the ion source is an electrospray ionisation needle.

19. A method of focusing and conveying ions comprising applying only one electrical signal to each of a plurality of electrodes in series, the electrical signal being an alternating voltage waveform, the phase of the alternating voltage waveform applied to each electrode in the series being ahead of the phase of the alternating voltage waveform applied to the preceding electrode in the series by less than 180° such that the ions are focused on to an axis of travel and advanced along the series of electrodes.

20. A method as claimed in claim 19, wherein there is the same phase-difference between all adjacent electrodes.

21. A method as claimed in claim 20, wherein the phase-difference is 360°/n, where n is a natural number greater than two.

22. A method as claimed in claim 20, wherein the phase-difference is 360°/n, where n is a natural number greater than three.

23. A method as claimed in claim 19, wherein the waveform of the applied alternating voltage is sinusoidal.

24. A method as claimed in claim 19, wherein the frequency of the applied alternating voltage waveform is less than 100 kHz.

25. A method as claimed in claim 19, wherein the frequency of the applied alternating voltage waveform is altered.

26. A method as claimed in claim 25, wherein the frequency of the applied alternating voltage waveform is swept.

27. A method as claimed in claim 26, wherein the frequency of the applied alternating voltage waveform is swept over a range of at least 100 kHz.

28. A method as claimed in claim 19, wherein the voltages are applied to the electrodes and/or the electrodes are arranged such that ions are focused and advanced along a curved path.

29. An ion focusing and conveying device comprising a plurality of electrodes in series, and means to apply a first alternating voltage waveform to each electrode, the phase of the alternating voltage in the first waveform applied to each electrode in the series being ahead of the phase of the first alternating voltage waveform applied to the preceding electrode in the series by less than 180° such that ions are focused onto an axis of travel and impelled along the series of electrodes, and the device further including means to apply a second alternating voltage waveform to each electrode simultaneously with the first to generate a series of Paul traps along the device.

30. A device as claimed in claim 29, wherein the means to apply a second alternating voltage waveform generates a series of static Paul traps along the device.

31. A device as claimed in claim 29, wherein the said plurality of electrodes includes a first set of electrodes and a second set of electrodes, the electrodes of the first set being arranged alternately with the electrodes of the second set, and the means to apply the second alternating voltage waveform being arranged such that the alternating voltage waveform applied thereby to the first set of electrodes is in anti-phase to the alternating voltage waveform applied thereby to the second set of electrodes.

32. A device as claimed in claim 29, wherein the means to apply a second alternating voltage waveform to each electrode is arranged such that anti-phase alternating voltages are applied to alternate electrodes.

33. A device as claimed in claim 29, wherein there is the same distance between each of the adjacent electrodes.

34. A device as claimed in claim 29, wherein the electrodes are all identical.

35. A device as claimed in claim 29, wherein each electrode defines a central aperture.

36. A device as claimed in claim 31, wherein the second alternating voltage waveform is in the range from 1 to 4 MHz in frequency.

37. A device as claimed in claim 29, wherein there is a common phase-difference between all adjacent electrodes in the first alternating voltage waveform.

38. A device as claimed in claim 37, wherein the common phase-difference is 360°/n, where n is a natural number greater than two.

39. A device as claimed in claim 37, wherein the common phase-difference is 360°/n, where n is a natural number greater than three.

40. A device as claimed in claim 29, wherein the means to apply the first alternating voltage waveform applies an alternating voltage with a sinusoidal waveform to each electrode.

41. A device as claimed in claim 29, wherein the frequency of the first applied alternating voltage is less than 100 kHz.

42. A device as claimed in claim 29, wherein the frequency of the first applied alternating voltage is altered in use.

43. A device as claimed in claim 42, wherein the frequency of the first applied alternating voltage is swept.

44. A device as claimed in claim 43, wherein the frequency of the first alternating voltage is swept over a range of at least 100 kHz.

45. A device as claimed in claim 29, wherein the plurality of electrodes or field is arranged to focus the ions to and impel them along a curved path.

46. A device as claimed in claim 45, wherein the electrodes are planar and lie on planes which are substantially radial to the curve.

47. Apparatus consisting of an ion source supplying ions directly onto a device according to claim 29, which in turn supplies ions directly into a mass analyser.

48. Apparatus as claimed in claim 47, wherein the ion source is an electrospray ionisation needle.

49. A method of focusing and conveying ions comprising applying a first alternating voltage waveform to each of a plurality of electrodes in series, the phase of the first alternating voltage waveform applied to each electrode in the series being ahead of the phase of the first alternating voltage waveform applied to the preceding electrode in the series by less than 180° such that the ions are focused on to an axis of travel and advanced along the series of electrodes, and the method further including applying a second alternating voltage waveform to each electrode simultaneously with the first to generate a series of Paul traps along the device.

50. A method as claimed in claim 49, wherein the application of the second alternating voltage waveform generates a series of static Paul traps along the device.

51. A method as claimed in claim 49, wherein said plurality of electrodes includes a first set of electrodes and a second set of electrodes, the electrodes of the first set being arranged alternately with the electrodes of the second set, and the second alternating voltage waveform being applied such that the alternating voltage waveform applied to the first set of electrodes is in anti-phase to the alternating voltage waveform applied to the second set of electrodes.

52. A method as claimed in claim 49, wherein the second alternating voltage waveform is applied to each electrode such that anti-phase alternating voltages are applied to alternate electrodes.

53. A method as claimed in claim 49, wherein the second alternating voltage waveform is in the range from 1 to 4 MHz in frequency.

54. A method as claimed in claim 49, wherein there is the same phase-difference between all adjacent electrodes in the first alternating voltage waveform.

55. A method as claimed in claim 54, wherein the phase-difference is 360°/n, where n is a natural number greater than two.

56. A method as claimed in claim 54, wherein the phase-difference is 360°/n, where n is a natural number greater than three.

57. A method as claimed in claim 49, wherein the waveform of the first applied alternating voltage is sinusoidal.

58. A method as claimed in claim 49, wherein the frequency of the first applied voltage waveform is less than 100 kHz.

59. A method as claimed in claim 49, wherein the frequency of the first applied voltage waveform is altered.

60. A method as claimed in claim 59, wherein the frequency of the first applied voltage waveform is swept.

61. A method as claimed in claim 60, wherein the frequency of the first applied voltage waveform is swept over a range of at least 100 kHz.

62. A method as claimed in claim 49, wherein the voltages are applied to the electrodes and/or the electrodes are arranged such that ions are focused and advanced along a curved path.

* * * * *

UNITED STATES PATENT AND TRADEMARK OFFICE

CERTIFICATE OF CORRECTION

PATENT NO. : 7,375,344 B2
APPLICATION NO. : 11/107617
DATED : May 20, 2008
INVENTOR(S) : Peter John Derrick et al.

It is certified that error appears in the above-identified patent and that said Letters Patent is hereby corrected as shown below:

Title Page, insert item (30):

--(30) Foreign Application Priority Data

Nov. 23, 2000 (GB)..... 0028586.6--

Signed and Sealed this
First Day of October, 2013

Teresa Stanek Rea
*Deputy Director of the United States Patent and Trademark Office*